United States Patent [19]

Bauer et al.

[11] Patent Number: 4,475,742

[45] Date of Patent: Oct. 9, 1984

[54] SAFETY SKI BINDING

[75] Inventors: Helmut Bauer; Erwin Krob, both of Wien, Austria

[73] Assignee: TMC Corporation, Baar, Switzerland

[21] Appl. No.: 345,110

[22] Filed: Feb. 2, 1982

[30] Foreign Application Priority Data

Feb. 4, 1981 [AT] Austria ..... 502/81

[51] Int. Cl.[3] ..... A63C 9/08

[52] U.S. Cl. ..... 280/632

[58] Field of Search ..... 280/611, 612, 613, 626, 280/633, 631, 632

[56] References Cited

U.S. PATENT DOCUMENTS

| | | | |
|---|---|---|---|
| 3,325,178 | 6/1967 | Reuge | 280/626 |
| 3,768,822 | 10/1973 | Kanno | 280/626 |
| 3,927,897 | 12/1975 | Olsen | 280/612 |
| 3,933,363 | 1/1976 | Schweizer | 280/632 |
| 3,961,801 | 6/1976 | Koryer | 280/626 |
| 4,060,257 | 11/1977 | Jungkind | 280/626 |
| 4,170,372 | 10/1979 | Salomon | 280/626 |
| 4,222,584 | 9/1980 | Kikuchi | 280/626 |
| 4,307,895 | 12/1981 | Storandt | 280/632 |

FOREIGN PATENT DOCUMENTS 2838904 3/1980 Fed. Rep. of Germany .

*Primary Examiner*—Joseph F. Peters, Jr.
*Assistant Examiner*—Michael Mar
*Attorney, Agent, or Firm*—Flynn, Thiel, Boutell & Tanis

[57] ABSTRACT

A safety ski binding has a bearing block with a locking projection, and a sole holder is supported on the bearing block for pivotal movement between a downhill skiing position and a released position. A locking part pivotally supported on the sole holder has a cam which engages the locking projection and has a surface on the opposite side thereof. a spring housing has one end pivotally supported on the bearing block and has an opening in the opposite end. A piston slidably supported in the spring housing has a piston rod which extends through the opening and slidably engages the surface on the locking part. A spring disposed in the spring housing urges the piston toward the locking part, thereby urging the cam against the locking projection. A mechanism is provided to obstruct sliding movement of the piston rod along the locking part surface from a first location thereon to a second location in which the effect of the spring on the locking part is reduced or absent. A manually actuable mechanism is provided for temporarily rendering the obstructing mechanism ineffective.

29 Claims, 19 Drawing Figures

SAFETY SKI BINDING

FIELD OF THE INVENTION

This invention relates to a safety ski binding and, more particularly, to a binding comprising a bearing block having a locking projection, a housing or a swivelling part which carries a sole down-holding means and a stepping spur and is supported on the bearing block for pivotal movement about a horizontal transverse axis, a locking spring which presses a cam on a swingably supported locking part against the locking projection and a release lever which makes possible a voluntary release of the binding.

BACKGROUND OF THE INVENTION

In a conventional binding of this type, for example that disclosed in German Offenlegungsschrift No. 24 32 711 (corresponds to U.S. Pat. No. 3,933,363), the spring housing is constructed in the form of a U-shaped support part, its end being supported swingably in the bearing block and its side parts having slotted holes which form a guideway for a locking member. The locking spring is supported on the locking member which in the downhill skiing position engages a control cam of the control part but in the released position is disposed in a recess in the control part. The support part is swivelled by means of the release lever, which is supported rotatably on the support part and is supported on the locking part.

This binding has the disadvantage that, during a voluntary release, the locking spring must be compressed by means of the release lever in order to swing the support part sufficiently upwardly so that the locking member leaves the control cam and comes to rest in the recess in the locking part. Therefore, the energy required to effect the voluntary release of the binding is considerable. Furthermore, the binding is susceptible to breakdowns, due to the various guide slots and due to the spring, which is not protected on all sides.

A similar binding is illustrated in German Offenlegungsschrift No. 29 00 239. Here too the locking spring is stored in a U-shaped support part, in the two sides of which are provided slotted holes which form a guideway for a locking member which is biased by a locking spring. The locking part is supported pivotally on an axle which rests with its two ends in semicircular notches provided in the upper boundary surfaces of the side parts of the bearing block. Such ends are gripped under by locking steps of the release lever in the locked position of the binding. The release lever is supported swingably on the binding housing.

If a voluntary release is to be started in this binding, the release lever is pressed down against the action of the spring. The locking steps of the lever thereby disengage from the axle of the locking part and the binding housing is swung upwardly by means of arcuate slotted holes, into which engages the axle of the locking part.

The force for the voluntary release of this binding is substantially reduced as compared with the first-mentioned binding. Furthermore, this force is constant and therfore independent from the preset initial tension of the locking spring. However, this binding has the disadvantage that the two locking steps of the release lever lie outside the binding housing and are therefore constantly exposed to dirt. Furthermore, this binding is of relatively complicated construction, due to the various guide slots and the fact that the support part which serves as a spring housing is not closed all around.

While in the above-discussed conventional safety ski bindings the support part which forms the spring housing and the binding housing are supported for rotation on a common axle, in the case of the binding according to German Offenlegungsschrift No. 26 28 748 the swivel axes for the swivelling part which carries the sole holder and the stepping spur and for the spring housing are spaced from one another, one being provided at the rear lower end of the bearing block and the other in the area of its upper side. The spring housing is here designed as a cylinder in which one spring abutment is formed by a setscrew which effects the adjustment of the initial tension of the spring and the other spring abutment is formed by a piston having a piston rod. This piston is not guided on the inner wall of the cylinder, but has sufficient clearance with respect to same so that not only a linear movement of the piston rod is possible, but also a certain degree of swivelling of the same.

In this binding, during a voluntary release, the end of the cylindrical spring abutment which is remote from the piston is lifted by means of a hand lever from a stop surface which is followed by an inclined ramp. Thus, the force which must be manually produced is not constant, as is often desired, but depends on the initial tension of the locking spring. Moreover, recreating the locked condition of the binding requires much strength, since the end of the cylinder which is remote from the piston must be pressed manually over the inclined ramp and onto the stop surface, whereby the full force of the locking spring be overcome.

A goal of the invention is to overcome the enumerated disadvantages of the conventional bindings and to provide a binding of the above-disclosed type which can be voluntarily released without a large amount of force and can thereafter be moved back into the downhill skiing position, which is relatively simple in its design, and in which the most important elements are protected against outside influences like dirt and damage.

SUMMARY OF THE INVENTION

This goal is achieved by providing a binding of the above-mentioned type, in which the spring housing is constructed as a cylinder, a piston with a piston rod which projects from the cylinder is guided movably in the cylinder but is secured against swivelling in an axial plane, and the locking part is lockable with respect to the end of the piston rod by means of a coupling mechanism which can be released manually.

Through the storing of the locking spring in a cylinder, through the exact guiding of the piston on the inner wall of the cylinder, and through the coupling mechanism which can be released manually, it is made possible that, during a voluntary release of the binding, the piston rod slides upwardly along the side of the locking part which faces the piston rod, resulting in an upward swiveling of the sole holder and thus a release of the ski boot.

According to a further characteristic of the invention, the end of the piston rod is secured against movement longitudinally of the locking part by means of a catch which is hinged to an axle and is swingable in a recess of the locking part, which catch forms the coupling mechanism. According to this, the coupling element which is to be operated manually, namely the catch, is moved into the locking part, where it is best protected against outside influences, since the locking part is in the center of the binding.

Many possibilities exist for controlling the catch. For example, it would be possible to move the catch in a direction which is inclined with respect to the longitudinal axis of the locking part. According to a further development of the invention, however, it has proven advantageous to support the axle for the catch on the locking part and to bias the catch with a spring which is supported in the locking part, which spring presses the catch into its locking position. It is thereby possible, according to a different characteristic of the invention, to construct the catch as a two-arm lever which carries at its upper end a transversely extending pin, the two ends of which are guided movably in slotted holes provided in the release lever. In this manner, it is possible, through a light manual lifting of the release lever against the force of the spring which acts onto the catch, to move the upper end of the catch so as to swing the lower end into the locking part, thereby releasing the outer end of the piston rod. The sole holder is thereafter swung upwardly, together with the binding housing. The locking part, which slides across the locking projection, also experiences a swivelling which, after the release lever has been released by the skier's hand, results in the catch returning to its initial position and the end of the piston rod ultimately being locked again.

In order to assure a reliable upward swinging of the spring housing, the invention provides furthermore that the latter has on its upper side an upwardly projecting plate-like extension which extends in a radial plane of the housing and has a slot which guidedly receives a pin which is secured on the release lever. With this, the release movement of the spring housing is started in a positive manner.

A further inventive suggestion also aims in this direction, namely, to place the spring housing under the influence of a spring which is independent of the spring for the binding housing. Thus, in this case, torque from the release lever or the spring of the binding housing is no longer transmitted to the spring housing through the release lever, but the spring housing instead swings upwardly under the influence of the mentioned spring.

According to a different inventive characteristic, the spring housing has on its upper side a flat stop surface which is associated with a stop secured on the bearing block. In this manner, it is possible to exactly fix the angle of movement of the spring housing relative to the bearing block and thus to reliably prevent a possible jamming of the individual elements.

In a different embodiment of the invention, the swivelling part and the spring housing are pivotal about different axes and a fork-shaped locking part and the catch are arranged on a common axle which is supported on the swivelling part. The upper end of the catch can thereby be provided with an extension which extends approximately perpendicular to the longitudinal axis of the lock. Thus, a substantially outwardly projecting release lever is not provided here which, in case of falls, can possibly result in injuries, but the release lever is formed by the extension itself and can be dimensioned so as to be relatively weak, since it is disposed in a recess of the swivelling part and therefore is substantially protected against damage.

In order to move the catch into its locking position, various solutions are possible, for example a torsion spring.

However, it has proven particularly advantageous if the extension of the catch biased by a pressure spring provided in a bore in the upper portion of the housing-like bearing block. Since this spring acts onto the end of the extension which functions as a release lever, it can be dimensioned relatively weak to permit an easy release.

Also, in the case of this embodiment of the invention, it has proven advantageous if the spring housing is biased by a torsion spring which urges it upwardly.

All solutions which have been dealt with up to now referred to exemplary embodiments in which the coupling member which is manually operable is disposed in the locking part. However, solutions are also possible in which the coupling mechanism can be released manually in a different way. Thus, in a binding in which the swivelling part and the spring housing are pivotal about different axes, it is provided according to the invention that the piston rod is approximately rectangular in cross section and has an end which is provided with a transverse row of teeth, with which are associated grooves between teeth which are provided on the locking part and extend approximately in the longitudinal direction thereof. The voluntary release of the binding is caused in this case by relative movement of the spring housing with respect to the locking part. The path of this movement must be at least one tooth width.

This relative movement could, for example, be a swivelling movement, the axle of rotation of the spring housing being supported in a fork which is pivotally supported on the bottom plate of the bearing block. However, it has proven advantageous to move the spring housing in the direction of its axle of rotation. For this case, the invention provides that the spring housing has on its upper side an extension which extends in the direction of a vertical radial plane and is defined for example by two plates, which extension carries on at least one side a control cam, with which is associated a countercam provided on a side surface of the release lever.

If a control cam is arranged on only one side of the extension, then a force from a spring must be provided to act onto the other side of the extension to continuously urge the control cam against the countercam. If, on the other hand, control cams are arranged on both sides of the extension so as to cause a forced guiding of the spring housing, then of course the pressure spring is not needed.

It is suggested further according to the invention that the release lever be supported on the axle of rotation of the swivelling part and that the extension on the spring housing have a slotted hole which extends approximately parallel to its axis, in which slotted hole is guided a pin which is secured on the release lever. The invention includes furthermore the use of an electromagnet, the armature of which acts onto the release lever, catch, or the movable spring housing. This solution enables an electrical release of the binding.

Finally, according to the invention, projections are provided on both inner side surfaces of the release lever which cooperate with correspondingly arranged cams on both sides of the spring housing.

BRIEF DESCRIPTION OF THE DRAWINGS

Different embodiments of the inventive safety ski binding are illustrated in longitudinal cross-sectional views in the drawings, namely the embodiments of FIGS. 1–3, FIGS. 4–8, FIGS. 9–13 and FIGS. 14–16. In the drawings.

DETAILED DESCRIPTION

Figure 1:
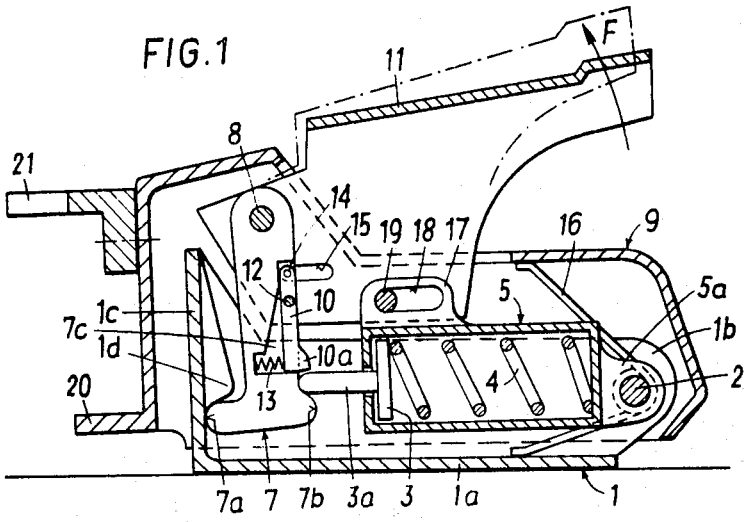
FIG. 1 is a sectional side view which illustrates a ski binding embodying the present invention in the engaged, downhill skiing position.
Figure 2:
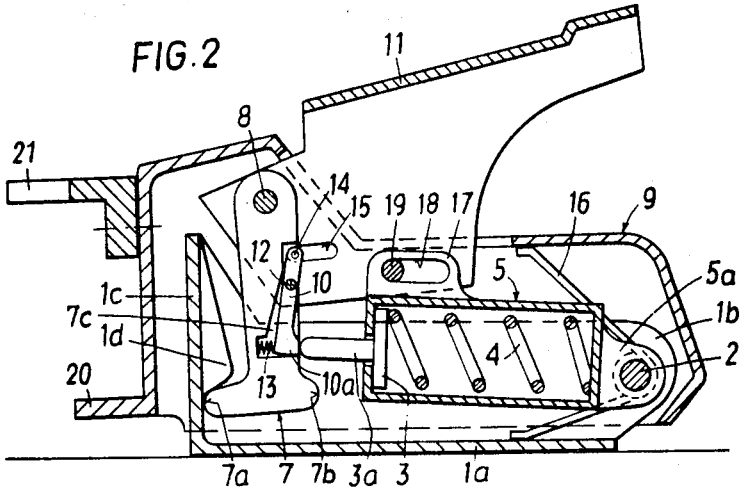
FIG. 2 is a sectional side view which illustrates the embodiment of FIG. 1 during a voluntary release.
Figure 3:
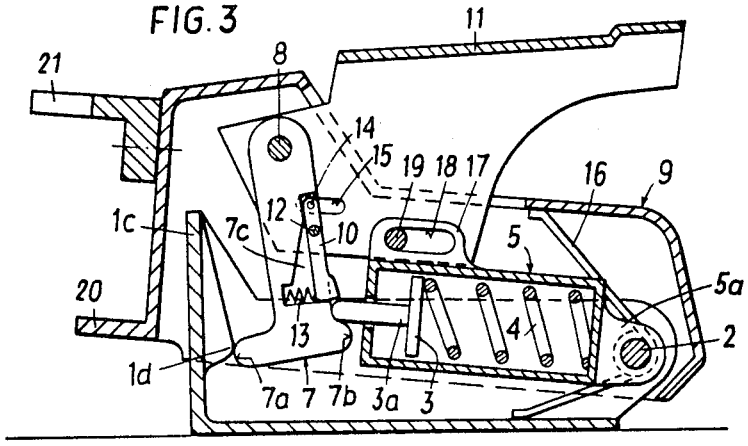
FIG. 3 is a sectional side view which illustrates the embodiment of FIG. 1 during an automatic release.

The safety ski binding according to FIGS. 1–3 consists substantially of a base member or bearing block 1 which is secured in a conventional manner on the upper side of a ski, the cylindrical spring housing 5 which is pivotally supported on the bearing block, a binding support housing 9 which covers the bearing block and is also pivotally supported thereon, and a release lever 11 which is rotatably supported on the binding housing 9.

The bearing block 1 includes a bottom plate 1*a*, two side walls 1*b* and a front wall 1*c*, on the inner side of which is provided a locking projection 1*d*. An axle 2 is supported by the side walls 1*b* at the end of the bearing block 1 opposite the locking projection 1*d*, on which axle 2 and the spring housing 5 is supported between the two side walls 1*b* by a bearing eye 5*a* and on which the binding housing 9 is supported outside of the side walls 1*b*.

A locking member which is here a piston 3 is supported movably in the spring housing 5 and is urged leftwardly by a helical locking spring 4 which is a compression spring. The piston rod 3*a* of the piston 3 projects toward the locking projection 1*d* through an opening in the end of the spring housing 5. A locking part 7 of approximately T-shaped design is provided between the locking projection 1*d* and the piston rod 3*a*, the T being rotated 180° so as to be inverted. The locking part 7 has two cam surfaces 7*a* and 7*b* on opposite sides thereof, one (7*a*) being associated with the locking projection 1*d* and the other (7*b*) being associated with the outer end of the piston rod 3*a*. The locking part 7 is pivotally supported at the free end of the stem of the T by means of an axle 8 supported on the binding housing 9. The axle 8 also carries, between locking part 7 and the housing 9, the release lever 11. In other words, the release lever 11 is generally U-shaped and has two spaced side walls which are pivotally supported on the axle 8 within the walls of the housing 9, the locking part 7 being supported on the axle 8 between the legs of the release lever 11.

A blocking element or catch 10 which is constructed in the form of a two-arm lever is arranged in a recess 7*c* provided in the locking part 7 and is supported pivotally on an axle 12, said two arms thereof being the portions on opposite sides of the axle 12. The catch 10 is under the influence of a weak helical spring 13 which is located in recess 7*c* and presses the lower catch arm outwardly into a locking position in which it obstructs the end of the piston rod 3*a* from sliding upwardly along the cam surface 7*b*. The catch 10 carries a pin 14 at the end of the upper arm thereof which is guidedly received in a slot 15 provided in a sidewall of the release lever 11.

A torsion spring 16 is arranged around the axle 2 and continuously tries to swing the binding housing 9 in a clockwise direction. The spring housing 5 has at its upper side an extension 17 with a slot 18 therein, in which slot a pin 19 is guidedly received. When the release lever 11 is swivelled, the pin 19 is moved in the slot 18. The pin 19 is secured on the sidewalls of the release lever 11. The housing 9 carries a sole holder 21 and a stepping spur 20 on the front side thereof.

This safety ski binding operates as follows, the engaged position used for downhill skiing being illustrated in FIG. 1. If the binding is to be voluntarily released from this position, then the release lever 11 is manually swung upwardly in the direction of the arrow F about the axle 8 to the position shown in broken lines in FIG. 1. The pin 14 which is initially at an end of the slot 15 is thereby pulled out of the recess 7*c* in the locking part 7 by the release lever 11, so that the catch 10 pivots and the lower lever arm of the catch 10 is swung deeper into the recess 7*c* in the locking part 7 against the urging of the spring 13. The lower end 10*a* of the catch 10 thereby releases the outer end of the piston rod 3*a* so that it can slide upwardly along the cam surface 7*b* away from its initial position under the urging of the locking spring 4, as shown in FIG. 2. The spring housing 5 is thereby, with the help of the release lever 11 and the cooperation of pin 19 and slot 18, pivoted about axle 2. Furthermore, since the binding housing 9 is under the influence of the torsion spring 16 and the piston 3 comes to rest on a stop, namely the end of the housing 5, it is now easy to finish opening the binding by further swivelling the release lever 11. The cam 7*a* of the locking part 7 slides over the locking projection 1*d* and the binding snaps open. Thus, by swivelling the catch 10 against the force of the relatively weak spring 13, the force of the spring 4 which acts onto the locking part 7 is cancelled because the piston 3 comes to rest on the end wall of the spring housing 5, and subsequently the housing 9 can swing, under the influence of the spring 16, upwardly until it engages a stop which is not illustrated. At this point in time, the end of the piston rod can be returned to its position under the lower end 10*a* of the catch.

The return of the piston rod 3*a* to its position under the lower end 10*a* of the catch 10 is effected by manually pivoting the release lever 11 downwardly to its initial position relative to the housing 9. This causes the pin 9 to act on the extension 17 and pivot the spring housing 5 downwardly so that the piston rod slides downwardly along the cam surface 7*b* on the locking part 7 until it is in the position illustrated in FIG. 3, and simultaneously cancels the engagement between the end of the slot 15 and the pin 14 of the catch 10 so that the catch 10 can pivot back to its original position under the urging of the spring 13 when the piston rod 3*a* reaches the position illustrated in FIG. 3.

With respect to the voluntary release, it is important to note that as the piston rod 3*a* slides up the cam surface 7*b*, the piston 3 moves leftwardly in the housing 5, so that the forces applied by the spring 4 onto the locking part 7 are gradually reduced. Thus, a voluntary release does not require any compression of the spring 4. Moreover, as the piston rod 3*a* slides nearer to the axle 8, the length of the effective lever arm for the application of the force of the spring 4 to the locking part 7 is reduced, rendering it easier to pivot the locking part 7 against such force.

If, on the other hand, as shown in FIG. 3, the binding is in the engaged position and an automatic release of the binding occurs, then the cam 7*a* is pulled upwardly over the locking projection 1*d*, causing the spring housing 5 to pivot about the axle 2 because the end of the piston rod 3*a* remains in engagement with the cam surface 7*b* and the locking part 7 is supported on the binding housing 9. As soon as the cam 7*a* has passed the release point of the locking projection 1*d*, the binding housing 9 will be swung upwardly in a clockwise direction under the influence of the torsion spring 16 and will free the ski boot.

The embodiment of the inventive safety ski binding which is illustrated in FIGS. 4–8 differs from the first exemplary embodiment by the provision of a stop 30 on the bearing block 1, which stop provides a limit on the angle of upward pivotal movement of the spring housing 5. Associated with the stop 30 is a flat surface 31 provided on the upper side of the spring housing 5. Aside from the torsion spring 16 which engages the binding housing 9, further torsion spring 32 is provided on the axle 2, which torsion spring 32 tries to swing the spring housing 5 in a clockwise direction.

Figure 4:
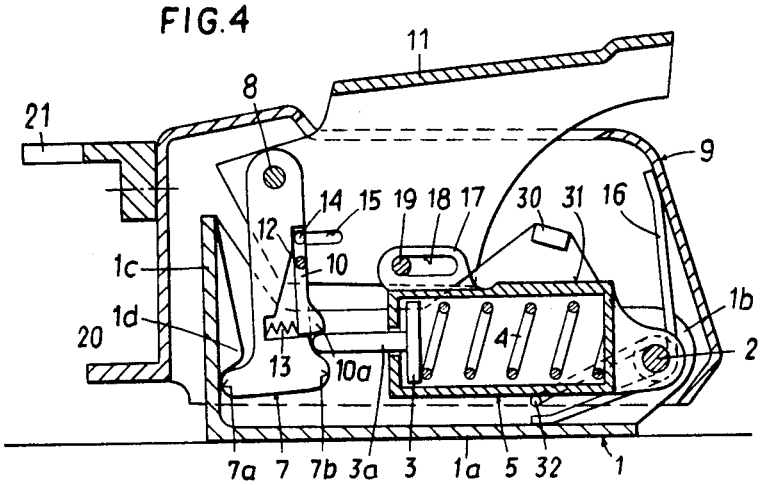
FIG. 4 is a sectional side view which illustrates a second embodiment of the ski binding of FIG. 1 in the engaged position.
Figure 5:
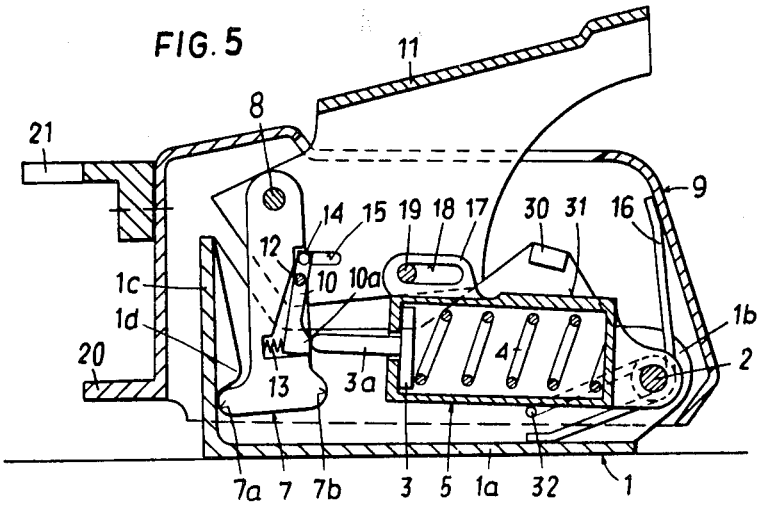
FIG. 5 is a sectional side view which illustrates the embodiment of FIG. 4 during a voluntary release.
Figure 6:
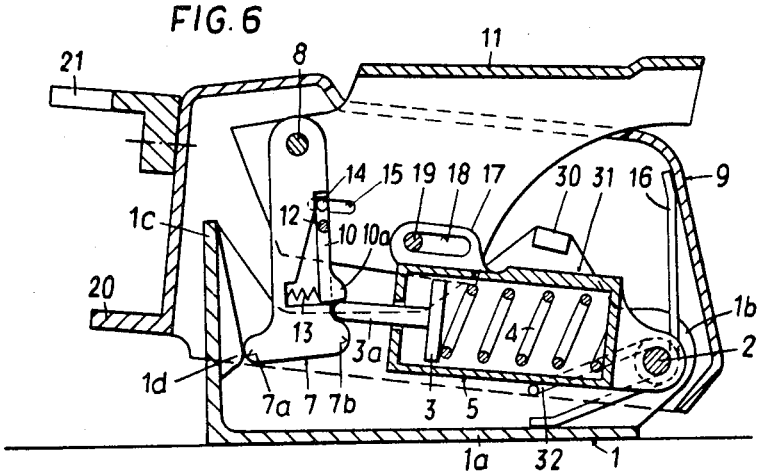
FIG. 6 is a sectional side view which illustrates the embodiment of FIG. 4 during an automatic release.
Figure 7:
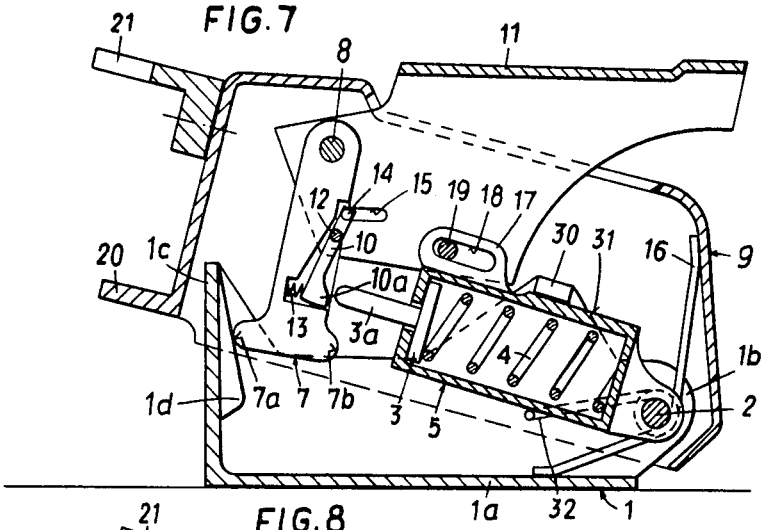
FIG. 7 is a sectional side view which illustrates the embodiment of FIG. 4 during a voluntary release, but at a slightly later point in time as compared with FIG. 5.
Figure 8:
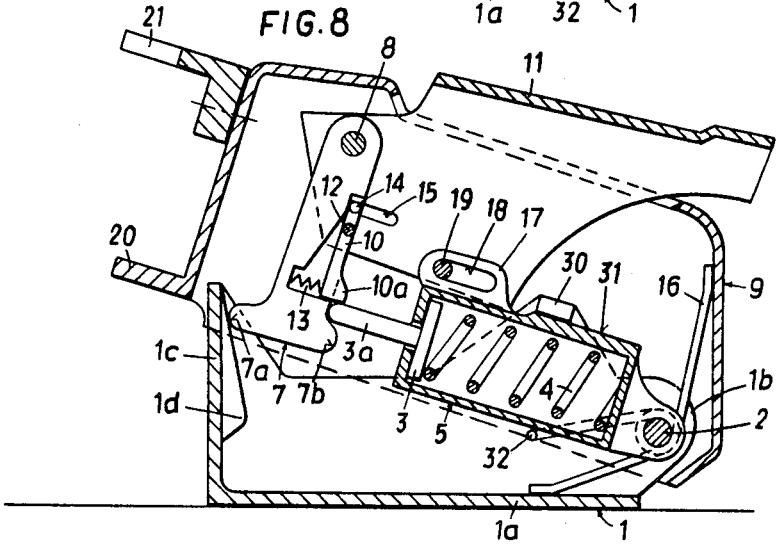
FIG. 8 is a sectional side view which illustrates the embodiment of FIG. 4 at yet a later point in time.

FIG. 4 illustrates the positions of the binding components in the engaged position of the binding, FIG. 5 illustrates their positions during a voluntary release, and FIG. 6 illustrates their positions during an automatic release. FIGS. 7 and 8 illustrate two further positions of the components of the binding in which the spring housing 5 rests with its flat surface 31 against the stop 30 of the bearing block 1. FIG. 7 illustrates the position of the components shortly after the cam 7*a* has passed the release point of the locking projection 1*d* and FIG. 8 illustrates the final position during a voluntary and also during an automatic release in which the lifting of the locking part 7 which securely holds the outer end of the piston rod 3*a* effectively limits the independent swivelling movement of the sole holder 21. The safety ski binding is now ready to be stepped into.

When a voluntary release occurs in this embodiment, the spring housing 5 moves upwardly until it engages the stop 30 as described above. Then, as the housing 9 pivots to the release position, the effect of the stop 30 on the spring housing 5 forces the piston rod 3*a* to slide down the cam surface 7*b* until it is in its original position and the catch 10 is returned by the spring 13 to its original position, as shown in FIG. 8.

A further exemplary embodiment of the inventive ski binding is illustrated in FIGS. 9—13. The bearing block 40 is constructed here like a housing and includes a bottom plate 40*a*, two side walls 40*b* and a front wall 40*c* which carries a locking projection 40*d*. A first axle 44 extends between the two side walls 40*b*, and pivotally supports a spring housing 45 which is under the action of a leg spring 46. The swivelling movement of the housing 45 is limited by a stop 47. A piston 48 is guidedly supported in the spring housing 45, the piston rod 49 of which projects outwardly through an opening in the spring housing 45.

The bearing block 40 also carries in its upper area an axle 50 which rotatably supports a swivelling part 51 which is under the influence of a not illustrated torsion spring which urges it to swing in a clockwise direction. Thus, in this exemplary embodiment, in contrast to the embodiments dealt with up to now, the swivelling part 51, which carries a sole holder 52 and a stepping spur 53, and the spring housing 45 have separate pivot axles 50 and 44, respectively.

Figure 9A:
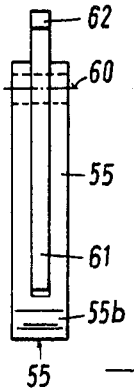
FIG. 9*a* is a rear view of selected components of the embodiment of FIG. 9.
Figure 9:
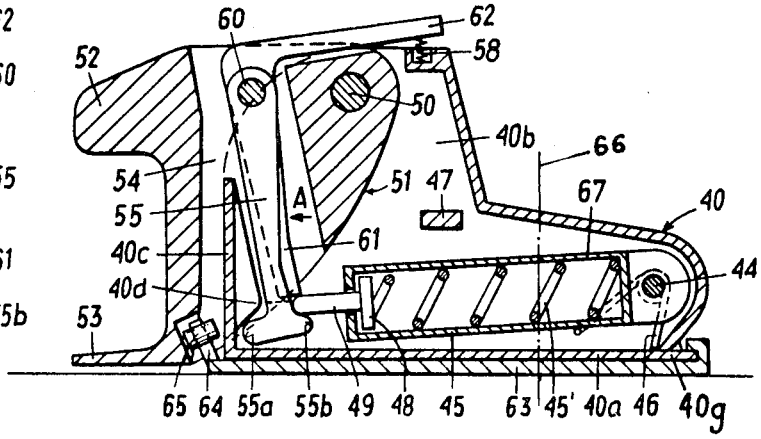
FIG. 9 is a sectional side view which illustrates a third embodiment of the ski binding of FIG. 1 in the engaged position.
Figure 10:
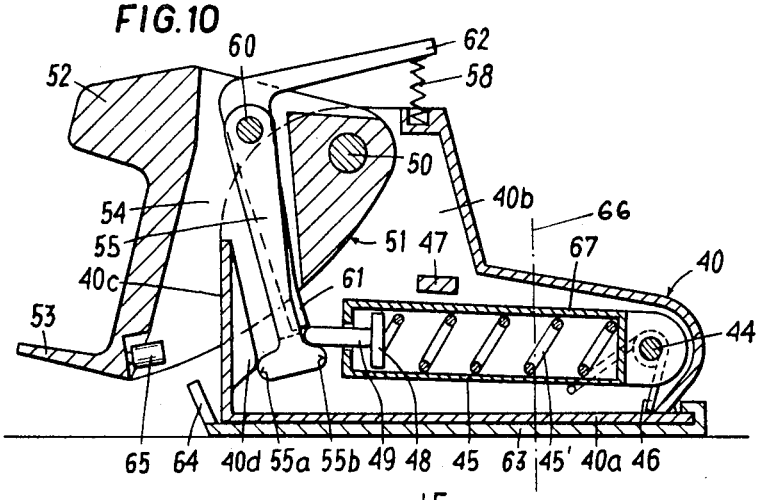
FIG. 10 is a sectional side view which illustrates the embodiment of FIG. 9 during an automatic release.
Figure 11:
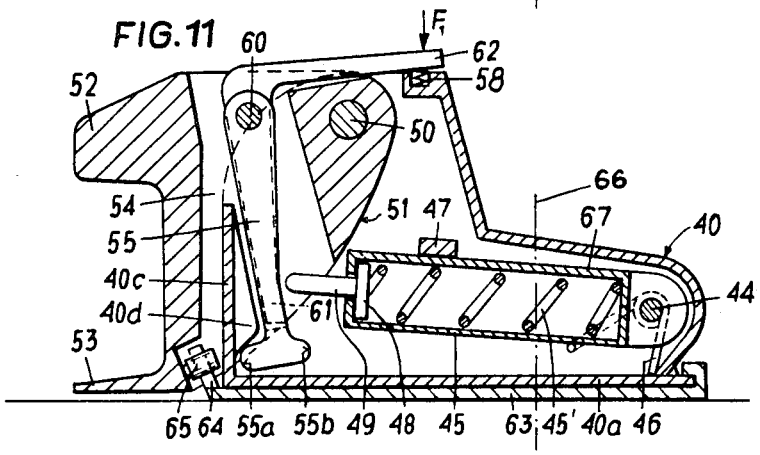
FIG. 11 is a sectional side view which illustrates the embodiment of FIG. 9 at the start of a voluntary release.
Figure 12:
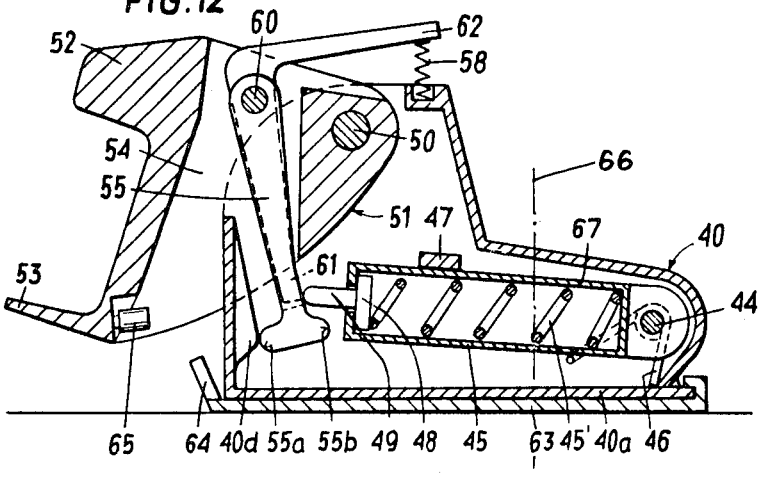
FIG. 12 is a sectional side view which illustrates the embodiment of FIG. 9 at a slightly later point in time during the voluntary release.

The swivelling part 51 has an approximately vertical recess 54 therethrough in which a locking part 55 is provided. The locking part 55 in this embodiment again has approximately the shape of an inverted T, one end of the cross part of the T carrying a cam 55*a* which is associated with the locking projection 40*d* and the other end carrying a cam surface 55*b* which is associated with the outer end of the piston rod 49. The locking part 55 is rotatably supported on an axle 60 which is supported by the swivelling part 51. The locking part 55 is designed forked through almost the entire vertical area thereof, as illustrated in FIG. 9*a*, and between the two prongs of the fork a catch 61 is provided. The catch 61 extends upwardly beyond the axle 60 and has there an extension 62 which extends approximately at a right angle with respect to the part below axle 60. Extension 62 is urged upwardly by a weak helical spring 58 which is supported in the bearing block 40. The bottom plate 40*a* of the bearing block 40 is pivotally supported in a conventional manner on a base plate 63 for movement about an axis 66 which is indicated by a broken line in the drawings (FIG. 9). The base plate 63 grips with its rear end around a rearward projection 40*g* of the bottom plate 40*a* and thus secures same against upward movement. The other end of the base plate 63 carries a control cam 64, along which rollers 65 supported on the swivelling part 51 can roll.

The operation of this safety ski binding is as follows. The cam 55*a*, in the downhill skiing position, rests on the underside of the locking projection 40*d*. This is effected by spring 45' which is provided in the spring housing 45 and, through the piston 48 and the piston rod 49 which rests on the cam surface 55*b*, urges the locking part 55 to this position (see FIG. 9). The piston rod 49 is prevented from sliding upwardly by the lower end of the catch 61.

If, during downhill skiing, an automatic release of the binding is caused by an upward force, then the cam 55*a* slides upwardly past the release point of the locking projection 40*d* and the swivelling part 51 moves to release the ski boot. The outer end of the piston rod 49 is held in its position on the cam surface 55*b* by the catch 61. Consequently, the spring housing 45, which is under the influence of the torsion spring 46, is also swung upwardly in a clockwise direction to a position against the stop 47 in FIG. 10.

The same effect occurs if a force is applied by the sole holder 52 onto the swivelling part 51 and thus onto the bearing block 40 in a plane which is inclined with respect to the horizontal. The swivelling part 51, in this case, pivots about axis 66 and is lifted by the roller 65, which rolls up the control cam 64 until the cam 55*a* crosses the release point of the locking projection 40*d*. With this, the release occurs.

If, however, a voluntary release of the binding is to be initiated, then the extension 62 is manually pressed down in the direction of arrow $F_1$ (FIG. 1) against the force of the weak spring 58. With this, the lower end of the catch 61 is moved between the two legs of the forked locking part 55, whereby the piston rod 49 is released and the spring housing 45 is swung clockwise by the torsion spring 46 until it rests against the stop 47. The swivelling part 51 is, at the same time, swung in a clockwise direction by the not illustrated torsion spring associated with it which is arranged in the area of the axle 50, especially since the locking part 55 is relieved from the urging of the locking spring 45' (compare FIG. 12). The extension 62, when released by the hand of the user, will return under the influence of the spring 58 to its rest position. The catch 61 can thus engage again the end of the piston rod 49 which rests against the cam 55*b* (FIG. 13) so that, after the user steps into the binding with his boot, the original condition will again be created.

Figure 14:
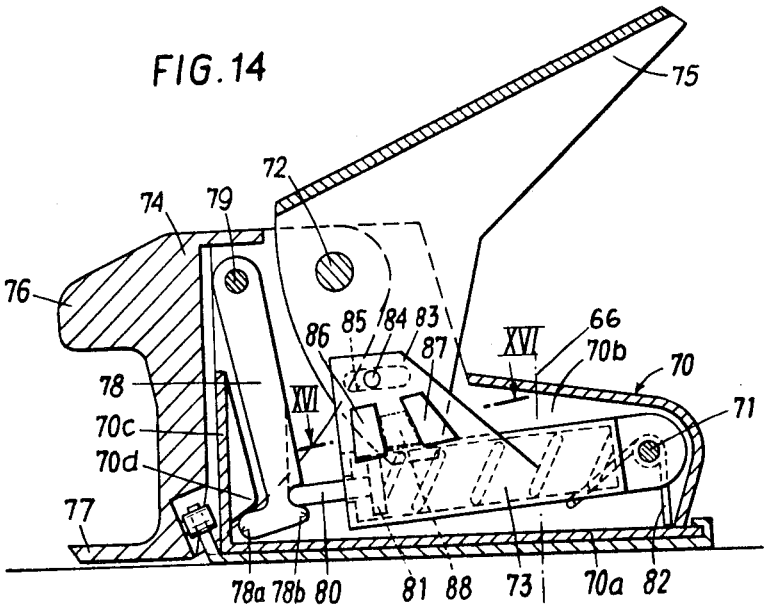
FIG. 14 is a sectional side view which illustrates a fourth embodiment of the safety ski binding of FIG. 1 in an engaged position.
Figure 15:
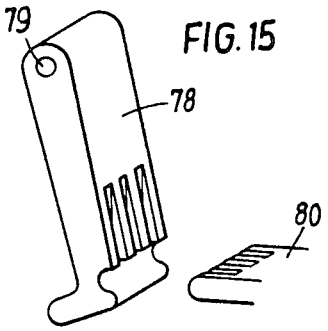
FIG. 15 is a perspective view of selected components of the embodiment of FIG. 14.
Figure 16:
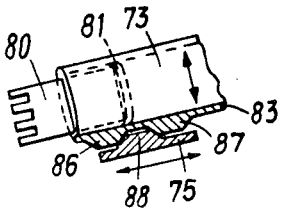
FIG. 16 is a cross-sectional view taken along the line XVI—XVI of FIG. 14 and illustrates details of the embodiment of FIG. 14.

An embodiment which is similar to the last-described embodiment, in particular with respect to the provision of a roller and an associated control cam, is illustrated in FIGS. 14–16. This exemplary embodiment also includes a bearing block 70 which has a bottom plate 70*a*, two side walls 70*b*, a front wall 70*c* and a locking projection 70*d*. Two axles 71 and 72 are arranged in the two side walls 70*b*, the axle 71 supporting a spring housing 73 and the axle 72 supporting a swivelling part 74 and a release lever 75.

A locking part 78 is pivotally supported by means of an axle 79 in a recess in the swivelling part 74. The swivelling part 74 again carries a sole holder 76 and a stepping spur 77. The locking part 78, which is constructed approximately in the shape of an inverted T, carries at its lower end two control cams 78*a* and 78*b*, cam 78*a* being associated with the locking projection 70*d* on the bearing block 70, which here too is constructed housing-like. The cam surface 78*b* engages the outer end of the piston rod 80 of the piston 81, which is guidedly supported in the spring housing 73. The piston rod 80 is not cylindrical but is rectangular in cross section, and the outer end thereof, viewed in the longitudinal cross section, is rounded (see FIG. 15). Moreover, this end is constructed like a rack, in that it has slots defining spaced blocking elements or teeth (FIGS. 15 and 16). Grooves corresponding to these teeth are provided in and extend longitudinally of the locking part 78 and define spaced teeth thereon. The bottoms of the grooves are a part of the cam surface 78*b*. When the teeth of the piston rod 80 are vertically aligned with the teeth of the locking part 78, then a voluntary release is not possible. To effect a voluntary release, the teeth of the piston rod 80 must be vertically aligned with the grooves in the locking part 78.

The spring housing 73, which is urged in a clockwise direction by a spring 82, is supported for axial movement along the axle 71. Furthermore, the spring housing 73 has an extension 83 which carries pin 84. The pin 84 is guided movably in a slot 85 provided in the release lever 75 in order to limit the angle of movement of the release lever 75 and in order to swing the spring housing 73 in a clockwise direction. Furthermore, the extension 83 has, at least on one side surface, two cams 86 and 87, between which is received cam 88 which in the preferred embodiment is trapezoidal in cross section and is arranged on a side wall of the release lever 75. A conventional leaf spring 92' engages the opposite side of the spring housing 73 and urges the spring housing 73 toward cam 88.

If the release lever 75 is not pivoted in either direction, then the cam 88 cooperates with a respective one of the two cams 86 and 87 and moves the spring housing 73 sufficiently along the axle 71 against the action of the leaf spring 92' so that the teeth of the piston rod 80 come into alignment with the grooves in the locking part 78. The spring housing 73 can now be swung clockwise by the torsion spring 82 as the teeth enter the grooves, whereby the locking part 78 slides easily past locking projection 70*d* as the swivelling part 74 pivots, whereby the binding is released.

Figure 17:
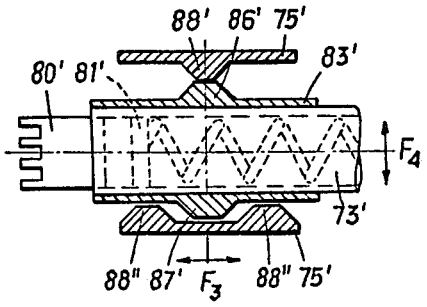
FIG. 17 is a variation of the embodiment according to FIGS. 14–16 and is a cross-sectional view similar to FIG. 16.

The embodiment according to FIG. 17 is similar to the FIGS. 14 to 16. A difference is that the release lever 75' has on both inner side surfaces cams 88', 88'', which cooperate with corresponding cams 86', 87', which are arranged on both sides of the spring housing 73'. The piston rod 80' of the piston 81' which is guided movably in the spring housing 73' is in this case also rectangular in cross section like in the embodiment above mentioned. The rectangular end of the piston rod 80' is constructed like a rack, in that it has slots defining spaced teeth which correspond to grooves which are provided in and extend longitudinally of the non-illustrated locking part and define spaced teeth thereon.

According to the embodiment shown in the FIGS. 14 to 16 the spring housing is biased by a leaf spring 92'. However, in this embodiment the cams of the spring housing 73' and release lever 75' cooperate to effect all axial movement of the spring housing. That means that by a swinging movement of the release lever 75' in one of two directions the cam 86' releases the cam 88' and the cam 87' slides on one of the two cams 88'' so that the spring housing 73' moves axially in one of the directions of the arrow $F_4$. Because of this sliding movement the teeth of the piston rod 80' becomes aligned with the grooves in the locking part. The spring housing 73' swings biased of its spring upwards and the sole holder swings to its released position.

Figure 13:
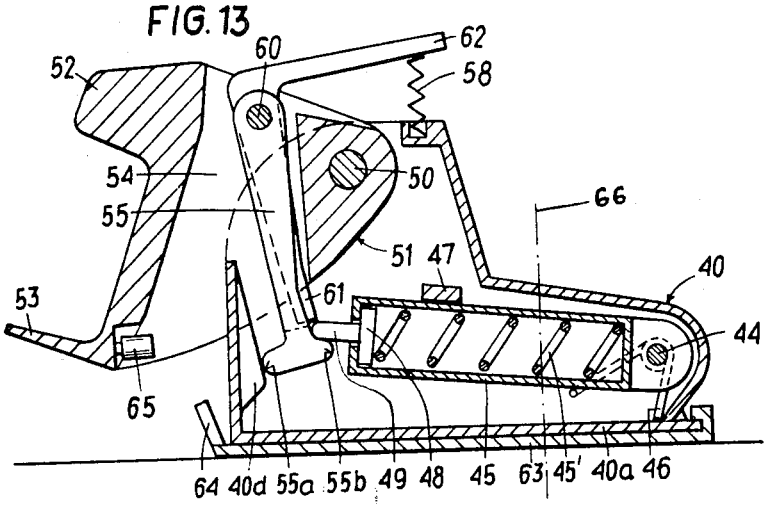
FIG. 13 is a sectional side view which illustrates the embodiment of FIG. 9 at the end of the voluntary release.
Figure 18:
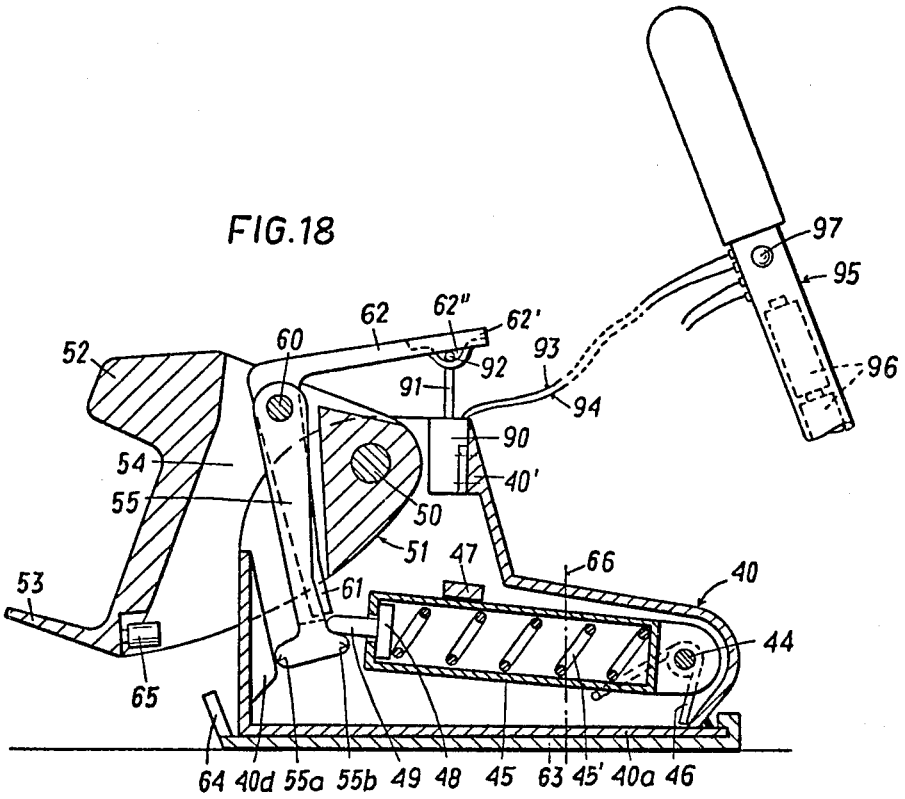
FIG. 18 is an embodiment having a voluntary release mechanism controlled by an electromagnet in a sectional view similar to FIG. 13.

The embodiment according to FIG. 18 is constructed like the embodiment according to FIG. 13. Because of this circumstance identical elements are marked with identical numerals. The difference with regard to FIG. 13 is that on the bearing block 40' there is arranged an electromagnet 90 instead of a spring 58. The armature 91 of the electromagnet 90 which is internally biased by a spring is connected by means of a bolt 92 with a yoke or clamp 62'' of the extension 62'. The electromagnet 90 is connected by means of circuits 93,94 with a ski pole 95 which could for example be that shown and described in the U.S. Pat. No. 3,246,907. The ski pole 95 comprises a hollow shaft in which arranged some batteries 96 which can be connected by means of an operated swich 97 through the wires 93,94 to the electromagnet 90.

For a manual release of the ski binding it is sufficient to operate the swich 97 where/upon the armature 91 of the electromagnet 90 urges the extension 62' downwardly so that the spring housing 45 swings upwardly and the swivelling part 51 and the sole holder 52 respectively become free. It is self-explanatory that both ski bindings of one pair of skis can be connected to the same ski pole in a parallel connection.

The embodiment according to the FIG. 18 has the effect that for a manual release of the ski binding it is not necessary for the skier to bend over. He can effect a manual release movement in his standing position.

Of course, the invention is not limited to the above-described exemplary embodiments which are illustrated in the drawings. Rather, there are modifications of the same, including the rearrangement of parts, which fall within the scope of the invention.

The embodiments of the invention in which an exclusive property or privilege is claimed are defined as follows:

1. A safety ski binding, comprising: a bearing block having a locking projection on an inner side of a front part thereof; a binding housing which has sole downholding means thereon, which is pivotally biased by a spring, and which is supported on the bearing block for pivotal movement about a horizontal transverse first axis; a locking part pivotally supported on the binding housing and having a cam thereon; a spring housing which is supported pivotally on the bearing block, which has a locking member movably supported thereon, and which has a locking spring which urges the locking member against the locking part so that the cam on the locking part is urged against the locking projection on the front part of the bearing block; and a release lever which is pivotally supported on the binding housing and adapted to effect a voluntary release of the binding; the improvement comprising wherein the spring housing is constructed as a cylinder; wherein a piston is axially movably supported in said cylinder, is secured against swivelling with respect to the spring housing about an axis parallel to the first axis, and has a piston rod which projects axially from the cylinder and is the locking member; and including coupling means for releasably locking an outer end of the piston rod against sliding movement in a direction along a surface on the locking part, the coupling means being manually releasable by means of the release lever.

2. The binding according to claim 1, wherein the outer end of the piston rod is secured against movement longitudinally of the locking part by a catch which is pivotally supported on an axle in a recess provided in the locking part, the catch being part of the coupling means.

3. The binding according to claim 2, wherein the axle of the catch is supported by the locking part and the catch is biased by a spring supported on the locking part toward a locking position in which it releasably locks the outer end of the piston rod against sliding movement along the locking part.

4. The binding according to claim 2, wherein the catch is a two-arm lever and carries a transversely extending pin at an upper end thereof, which pin has its two ends movably supported in slots provided in the release lever.

5. The binding according to claim 2, wherein the binding housing and the spring housing are pivotally supported on a common axle which is supported on the bearing block, and wherein the spring housing is pivotally biased by a spring which is independent of the spring which pivotally biases the binding housing.

6. The binding according to claim 2, wherein the binding housing and the spring housing are pivotal about different axles, and wherein the locking part and the catch are pivotally supported on a common axle which is supported on the binding housing.

7. The binding according to claim 6, wherein an upper end of the catch has an extension which extends approximately perpendicular to the remainder of the catch.

8. The binding according to claim 7, wherein the extension is biased by a compression spring which has one end supported on the extension and its other end disposed in a bore provided in an upper portion of the bearing block.

9. The binding according to claim 1, including a movably supported release lever having a pin thereon, and wherein the spring housing has on an upper side thereof an upwardly projecting plate-shaped extension which extends in a radial plane of the spring housing and has a slot in which is movably guided the pin which is provided on the release lever.

10. The binding according to claim 1, wherein the spring housing has on an upper side thereof a flat stop surface which is engageable with a stop provided on the bearing block.

11. The binding according to claim 10, wherein the spring housing is pivotally biased by a torsion spring.

12. The binding according to claim 1, wherein the binding housing and the spring housing are pivotal about different axles; and wherein the coupling means includes the piston rod being approximately rectangular in cross section and having at the outer end thereof a transverse row of teeth, and includes grooves which are defined by teeth provided on the locking part and can receive the teeth on the piston rod.

13. The binding according to claim 12, wherein the coupling means includes the spring housing being supported for movement in a direction parallel to its axis of rotation for a distance which is at least as large as the width of one of the teeth on the piston rod.

14. The binding according to claim 13, wherein the spring housing is biased by a spring which urges it in a direction parallel to its axis of rotation.

15. The binding according to claim 13, wherein the spring housing has on an upper side thereof an extension which extends in the direction of a vertical radial plane of the spring housing and has on at least one side thereof a cam which cooperates with a cam provided on the release lever to effect the axial movement of the spring housing.

16. The binding according to claim 15, wherein the release lever is supported for rotation about the axis of rotation of the binding housing, and wherein the extension on the spring housing has a slot therein which extends approximately parallel to the axis of the spring housing and which slidably receives a pin which is provided on the release lever.

17. The binding according to claim 15, wherein the release lever has two spaced walls which each have a cam thereon, wherein cams are provided on both sides of the extension on the spring housing and cooperate with the cams on respective walls of the release lever, so that movement of the release lever effects movement of the spring housing in a direction parallel to its pivot axis.

18. The binding according to claim 1, including an electromagnet which is supported on the bearing block and has an armature which can move the release lever.

19. A safety ski binding, comprising: a bearing block having on an inner side of a front part thereof a locking projection; a binding housing which has sole downholding means thereon, which is pivotally biased by a spring, and which is supported on the bearing block for pivotal movement about a horizontal transverse axis; a locking part pivotally supported on the binding housing and having a cam thereon; a spring housing which is supported pivotally on the bearing block, has a piston movably supported thereon, and has a locking spring which biases the piston so that a piston rod thereon engages the locking part and urges the cam on the locking part against the locking projection on the front part of the bearing block; and a catch which is pivotally supported on the locking part, can engage an outer end of the piston rod when in a locking position in a manner releasably locking the outer end of the piston rod against sliding movement along the locking part, and can be moved out of its locking position by a movably supported release lever.

20. The binding according to claim 19, wherein the catch is disposed in a recess provided in the locking part and is biased by a spring supported on the locking part in a direction toward its locking position.

21. A safety ski binding for releasably holding a ski boot on a ski, comprising: a base having means defining an upwardly extending wall; means defining a locking projection on one side of said wall; a sole holder adapted to engage a sole of the ski boot and supported on said base for approximately vertical movement between a downhill skiing position adjacent said base and a release position thereabove; a locking part disposed on said one side of said wall on said base and supported on said sole holder for pivotal movement about a generally horizontal, transverse first axis, said locking part having on a side thereof facing said wall a cam which is spaced radially from said first axis, which is movable toward and away from said wall approximately longitudinally of the ski in first and second directions, respectively, and which is engageable with said locking projection on said wall, said locking part having on a side thereof opposite said cam a sliding surface; a locking member disposed on a side of said locking part remote from said wall, supported for movement toward and away from said locking part approximately in said first and second directions, slidably engaging said sliding surface, and supported for sliding movement along said sliding surface away from an initial position in a third direction approximately toward said first axis while simultaneously being free of movement in said second direction; first resilient means cooperable with said locking member for yieldably urging it toward said locking part, thereby urging said cam on said locking part in said first direction toward said wall; a blocking element supported on said locking part; means for facilitating movement of said blocking element relative to said locking member when said locking member is in said initial position between a first position in which said blocking element resists sliding movement of said locking member along said sliding surface in said third direction away from said initial position and a second position in which said locking member can slide along said sliding surface in said third direction away from said initial position free of resistance by said blocking element and free of movement in said second direction against the urging of said first resilient means; and manually operable means for effecting said relative movement of said blocking element and said locking member.

22. The binding according to claim 21, wherein said means for facilitating movement of said blocking element relative to said locking member includes means defining a recess in said surface of said locking part, and includes said blocking element being movably supported in said recess and having a portion which is disposed entirely within said recess when said blocking element is in said second position and which projects outwardly past said surface on said locking part when said blocking element is in said first position.

23. The binding according to claim 22, including second resilient means cooperable with said blocking element for resiliently urging it toward said first position thereof, said manually operable means effecting movement of said blocking element from said first position to said second position against the urging of said second resilient means.

24. The binding according to claim 23, wherein said blocking element is elongate and is supported in said recess of said locking part for pivotal movement about a transverse horizontal axis located between its ends, said portion of said blocking element being located at one end thereof and said blocking element having a transversely extending pin at the opposite end thereof; and wherein said manually operable means includes a release lever which is supported on said sole holder for pivotal movement about a transverse horizontal axis and which has a generally horizontal slot therein at a location spaced radially from said pivot axis thereof, said pin on said locking element having a portion which is slidably received in said slot in said release lever.

25. The binding according to claim 23, wherein said recess in said locking part extends to said first axis; wherein said manually operable means includes a release lever supported on said sole holder for pivotal movement about said first axis independently of said locking part and having a portion which is movably disposed in said recess in said locking part, said portion of said release lever being said blocking element and having an end remote from said first axis which is said portion of said blocking element.

26. The binding according to claim 21, wherein said blocking element is fixedly supported on said locking part; wherein said means for facilitating relative movement of said blocking element and locking member includes said locking member being supported for movement relative to said locking part in directions approximately parallel to said first axis; and wherein said manually operable means includes means for effecting said axial movement of said locking member.

27. The binding according to claim 26, wherein said locking part has on said surface thereof a plurality of first teeth which are spaced in a direction approximately parallel to said first axis, one of said teeth being said blocking element; and wherein said locking member has means defining a plurality of slots therein which are spaced in a direction approximately parallel to said first axis, said teeth on said locking part being respectively aligned with and offset from said slots in said locking member when said locking part and said locking member are in said first and second positions.

28. The apparatus according to claim 27, including an axle supported on said base substantially parallel to said first axis and a support member supported on said axle for pivotal and axial movement with respect thereto, said locking member being supported on said support member for movement approximately radially of said axle; wherein said manually operable means includes a movably supported release lever having a portion adjacent said support member; and wherein said manually operable means includes cam means cooperable with said release lever and said support member for effecting axial movement of said support member and said locking member in response to movement of said release member.

29. The binding according to claim 21, including a support member supported on said base for pivotal movement about a second axis which is substantially parallel to said first axis, said locking member being supported on said support member for movement approximately radially of said second axis, movement of said locking member in said first and second directions corresponding to radial movement of said locking member with respect to said second axis and movement of said locking member in said third direction corresponding to pivotal movement of said support member and said locking member about said second axis; wherein said locking part extends generally downwardly from said first axis and movement of said locking member in said third direction is generally upward movement thereof; and including stop means provided on said base for limiting pivotal movement of said support member in a direction corresponding to movement of said locking member in said third direction.

* * * * *